US006511260B2

(12) United States Patent
Kenkel et al.

(10) Patent No.: US 6,511,260 B2
(45) Date of Patent: Jan. 28, 2003

(54) PLOW FOR INSTALLING UTILITY LINES

(75) Inventors: Brian Kenkel, Lake Ponderosa, IA (US); Keith A. Hoelting, Allterton, IA (US); James V. Reeves, Leighton, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/773,808

(22) Filed: Feb. 1, 2001

(65) Prior Publication Data

US 2002/0100192 A1 Aug. 1, 2002

(51) Int. Cl.[7] ..... F16L 3/22

(52) U.S. Cl. ..... 405/178; 405/180

(58) Field of Search ..... 405/174, 178, 405/179, 180, 181, 183

(56) References Cited

U.S. PATENT DOCUMENTS

| | | | | | |
|---|---|---|---|---|---|
| 3,300,989 | A | * | 1/1967 | Reising | 405/174 |
| 3,851,489 | A | * | 12/1974 | Richardson | 405/178 |
| 3,926,004 | A | * | 12/1975 | Baylor | 405/178 |
| 3,931,717 | A | * | 1/1976 | Schuck | 405/178 |
| 3,948,059 | A | * | 4/1976 | Pompa | 405/178 |
| 4,332,511 | A | * | 6/1982 | Bradley et al. | 405/178 |
| 4,661,018 | A | * | 4/1987 | Kinnan | 405/178 |
| 5,707,175 | A | * | 1/1998 | Geelhoed | 405/180 |
| 5,741,088 | A | * | 4/1998 | Kleyman | 405/181 |

FOREIGN PATENT DOCUMENTS

EP 0355278 A2 * 5/1989 ..... E02F/5/10

OTHER PUBLICATIONS 7 pages (including 3 pages of images)—Page 1entitled Super Vibratory Plow Brings "Attitude" to Fiber–Optic Project written by Richard Yach, provided by Vermeer Manufacturing.

3 sheets—front page; and pp. 60–61 of Outside Plant magazine dated Mar. 2000 article entitled Down 'N'Dirty by Richard Yach.

35–page manual (copy) entitled—Vermeer Parts Manual VP–4147 Plow.

4–page brochure entitled Flextrak75 by Vermeer Manufacturing Company.

4–page brochure entitled Vibratory Plow—Renegade P185 by Vermeer Manufacturing Company dated 1998.

4–page brochure entitled Vibratory Plow—Renegade P125 by Vermeer Manufacturing Company dated 2000.

(List continued on next page.)

*Primary Examiner*—Thomas B. Will
*Assistant Examiner*—Alexandra K. Pechhold
(74) *Attorney, Agent, or Firm*—Henderson & Sturm LLP

(57) ABSTRACT

A utility line guide chute disposed behind a plow for installing multiple utility lines. Divider members disposed between guide chute-side walls are provided for guiding the multiple utility lines in the top of the guide and out a lower rearward portion of the guide whereby utility lines can be laid into the ground at predetermined depths in vertically spaced relationships with respect to each other as the plow and guide chute move forward. A sidewall of the guide chute is composed of separate parts, the shape of respective ones of said separate parts corresponding at least in part to the position of each of more than one respective utility line within the guide whereby the separate parts of the second wall can be selectively removed to facilitate removal of selected ones of the utility lines without removing other ones of the utility lines.

18 Claims, 8 Drawing Sheets

OTHER PUBLICATIONS

6–page brochure entitled Hydrostatic Trencher/Plow V8550A by Vermeer Manufacturing Company—dated 1998.
6–page brochure entitled Mechanical Trencher/Plow V6500 by Vermeer Manufacturing Company—dated 1999.
6–page brochure entitled Mechanical Trencher/Plow V5800 by Vermeer Manufacturing Company—dated 2000.
6–page brochure entitled V–5750 Hydrostatic Trencher/Plow by Vermeer Manufacturing Company—dated 1997.
6–page brochure entitled Hydrostatic Trencher/Plow V4150A by Vermeer Manufacturing Company—dated 1998.
6–page brochure entitled Hydrostatic Trencher/Plow V3550A by Vermeer Manufacturing Company—dated 1997.

6–page brochure entitled Hydrostatic Trencher/Plow V120 by Vermeer Manufacturing Company—dated 1999.

4–page brochure entitled Plow/Trencher LM25 by Vermeer Manufacturing Company—dated 1998.

6–page brochure entitled Plow/Trencher LM42 by Vermeer Manufacturing Company—dated 1999.

* cited by examiner

PLOW FOR INSTALLING UTILITY LINES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates generally to plows for installing utility lines and more particularly to a plow to maintain vertically spaced relationship in the ground for such utility lines and allow for random extraction thereof.

In the past, utility lines which are run to homes and other buildings have been installed by each respective utility company, so these lines often have been laid in different paths and at different depths. In newer subdivisions, it is sometimes required that utility lines all be placed within a certain easement, which maybe quite narrow and make it impossible to have them be laid side by side; instead they must be separated by soil in the ground.

Consequently, a common practice was developed to dig a trench and then to lay down a first utility line and backfill it to a desired amount; then lay the second utility line in the trench, backfill to the desired amount, etc., for each utility line until all utility lines have been placed in the trench and backfilled.

There are typically several utility lines that need to be installed such as a natural gas line, an electric line, a cable television line and a telephone line. With modern communications, there may also be a fiber optic line which may be a combined line for cable television, internet and telephone.

Plows have been used to install utility lines, but it has heretofore not been practical to install all utility lines with one plow because it is time consuming and because it is difficult to remove certain desired ones of the utility lines at each junction box when not all of such lines are to be connected to such junction box. In order for such plowing operation to be practical, either all of the lines would need to come out at each utility box by pulling them out the back of a guide chute, selecting only the ones to be connected to the utility box and then placing them all back into the guide chute one by one in a last-out, first-in order.

It is, of course, impractical to plow one or more line in a narrow easement and then try to plow other utility lines in as well, because of the danger of breaking the previously laid utility lines.

There is, therefore, a need for a plow which will lay multiple utility lines in a single pass and yet provide adequate separation between the utility lines, while at the same time allowing random extraction of the utility lines at each junction box.

Those concerned with these and other problems recognize the need for an improved plow for installing utility lines.

BRIEF SUMMARY OF THE INVENTION

The present invention relates generally to a plowing apparatus for installing multiple utility lines having a plow adapted to be attached to a prime mover for cutting an opening in the ground to a predetermined distance below the surface of the ground as the prime mover moves along the top of the ground. A utility line guide chute is disposed behind of the plow and is operatively attached to the plow. The guide chute includes a forward wall, bottom wall, a first and second side wall operatively attached to the front wall and at least a partially opened top for receiving utility lines to be installed into the ground as the plow moves forwardly. Divider members are disposed between the first and second guide walls for guiding the multiple utility lines in the top of the guide and out a lower rearward portion of the guide whereby utility lines can be laid into the ground at predetermined depths in vertically spaced relationships with respect to each other as the plow and guide chute move forward.

In a preferred embodiment the second wall is composed of separate parts, the shape of respective ones of said separate parts corresponding at least in part to the position of each of more than one respective utility line within the guide whereby the separate parts of the second wall can be selectively removed to facilitate removal of selected ones of the utility lines without removing other ones of the utility lines. This permits the user to remove only those utility lines desired to be attached to a particular junction box without removing each and every one of the utility lines, thereby providing a random extraction ability.

Also in the preferred embodiment, cutters are attached to the guide and disposed on each side of at least two of the utility lines whereby the ground will be compacted around the first such selected lines and a predetermined distance will be maintained between such respective lines due to the cutters' ability to move soil and fill in such soil between such respective lines.

An object of the present invention is to provide an improved plow for installing multiple utility lines in a single pass.

Another object of the present invention is to provide a guide for a plow of the aforementioned type which allows random extraction of utility lines whereby only the utility lines desired to be extracted can be removed without removing all of the utility lines in order to accomplish this desired result.

Another object of the present invention is to provide a plow of the aforementioned type which has the ability to maintain a predetermined separation between utility lines being installed by a plow, and doing this in an automatic fashion.

Other objects, advantages and novel features of the present invention will become apparent from the following detailed description of the invention when considered in conjunction with the accompanying drawings.

DETAILED DESCRIPTION OF THE INVENTION

Figure 1:
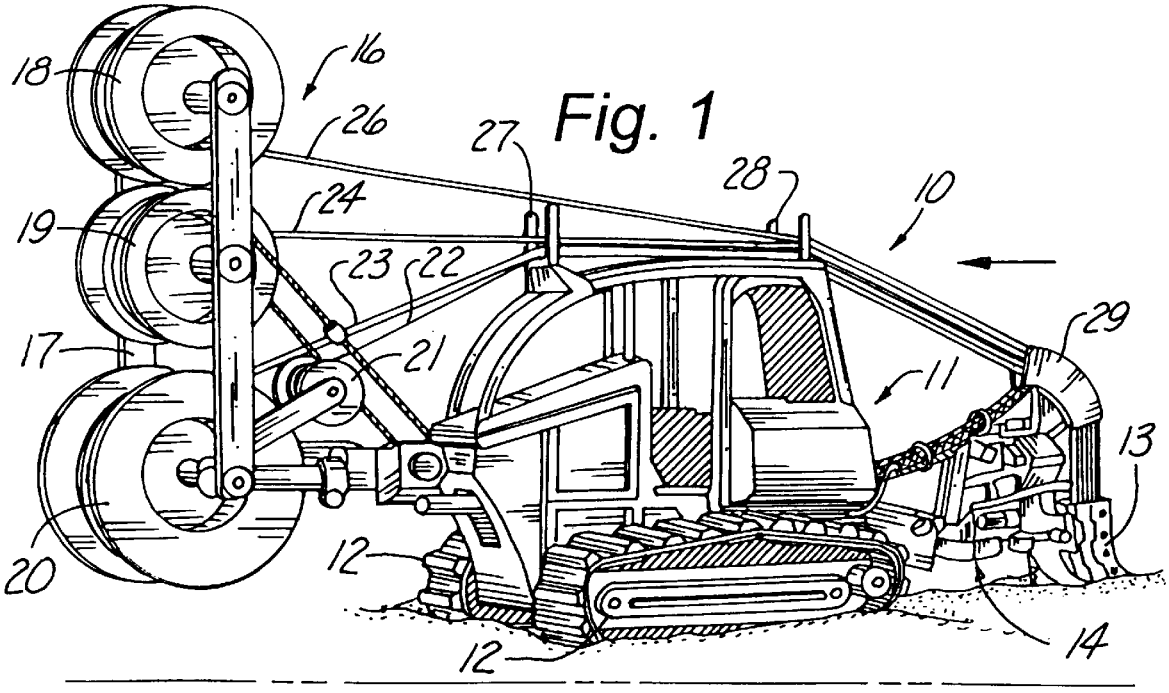
FIG. 1 is a perspective view of a preferred embodiment of the present invention showing the present invention attached to a prime mover and automatically plowing in three utility lines in a single pass.

Referring now to the drawings, wherein like reference numerals designate identical or corresponding parts throughout the several views, FIG. 1 shows an apparatus 10 for installing multiple utility lines in a single pass. The prime mover 11 has tracks 12 thereon for moving it forwardly or rearwardly. It is to be understood, however, that this could be a rubber tire prime mover or any other type of device for moving the plow in a desired direction.

A plow 13 is operably attached to the prime mover 11 by a connecting structure 14 which can provide vibration to the plow 13, but such vibration feature is not a necessary part of this invention.

Assembly 16 includes a carriage 17 having spools of utility lines 18, 19 and 20 thereon in addition to a spool 21 which has wire 22 for locating the position of a gas line 23, which is typically made of plastic and is therefore difficult to locate by traditional locating mechanisms which are designed for locating metals. The carriage 17 and spool assembly arrangement forms no part of this invention and could be provided in many other configurations other than the configuration shown.

Figure 3:
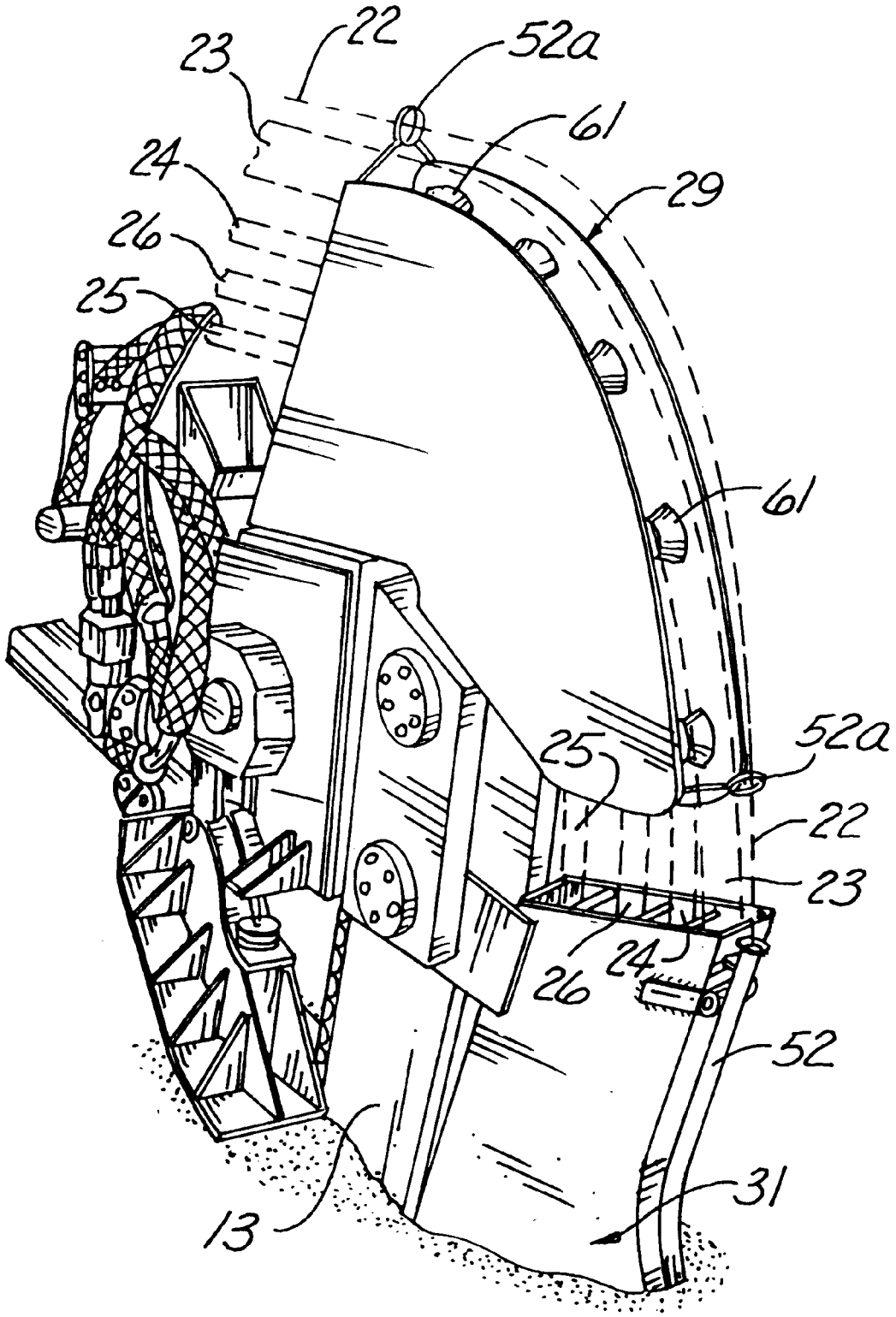
FIG. 3 is a partial perspective view of the present invention showing the plow and the guide chute for guiding the utility lines into the ground.

U-shaped guide members 27 and 28 are provided for guiding the wire 22 and the utility lines 23, 24 and 26 over the top of the prime mover and into a guide elbow 29 as shown in FIGS. 1 and 3. It is not important as to which of the spools 18, 19, 20 and 21 is on top or on the bottom, but only how they are inserted into the guide elbow 29, because they can be placed in any desired order depending on which utility lines are desired to be on top or on the bottom or in between.

Figure 4:
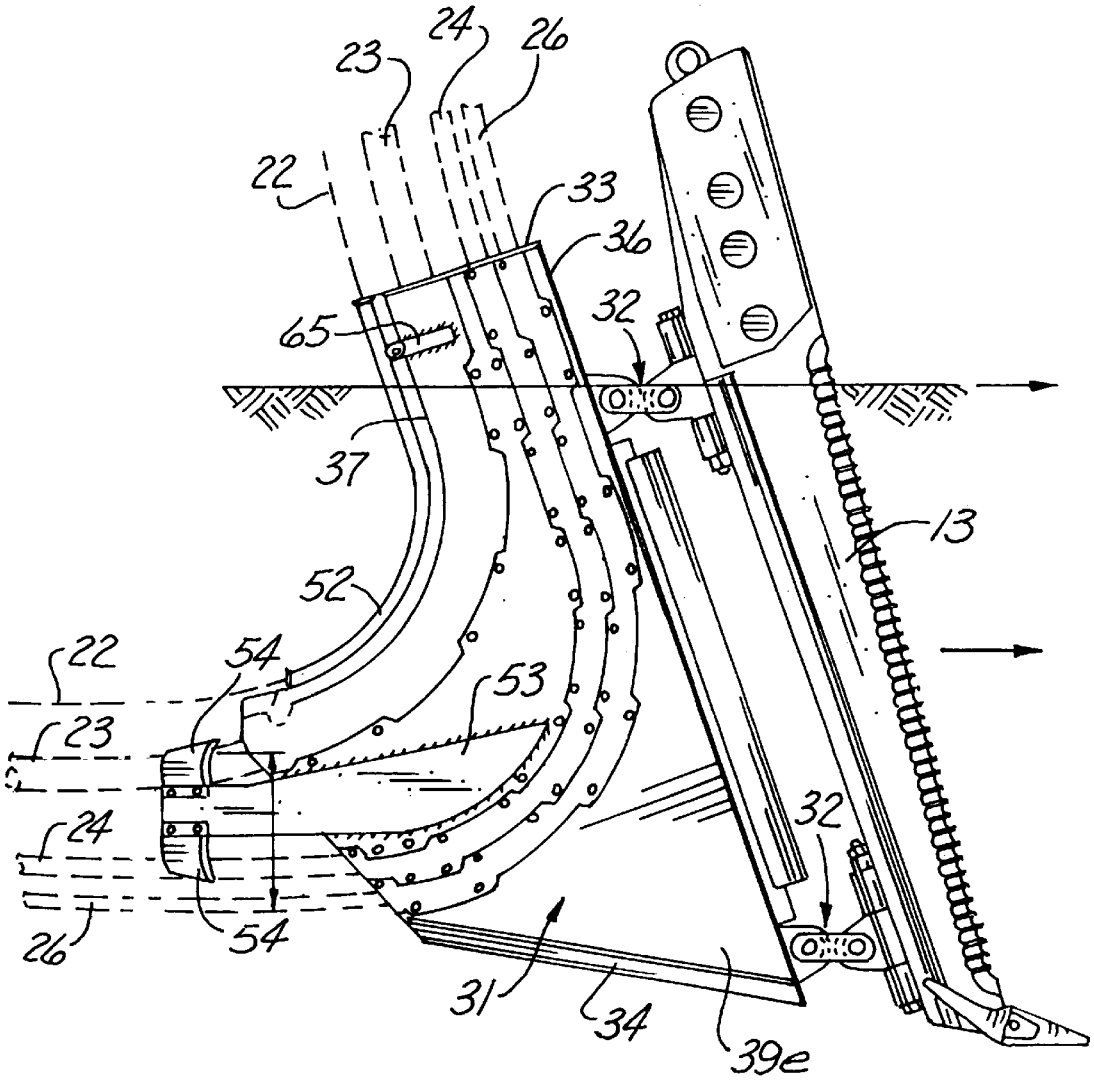
FIG. 4 is a side elevational view of the plow of the present invention shown in the ground with the guide chute disposed behind it for laying utility lines.
Figure 5:
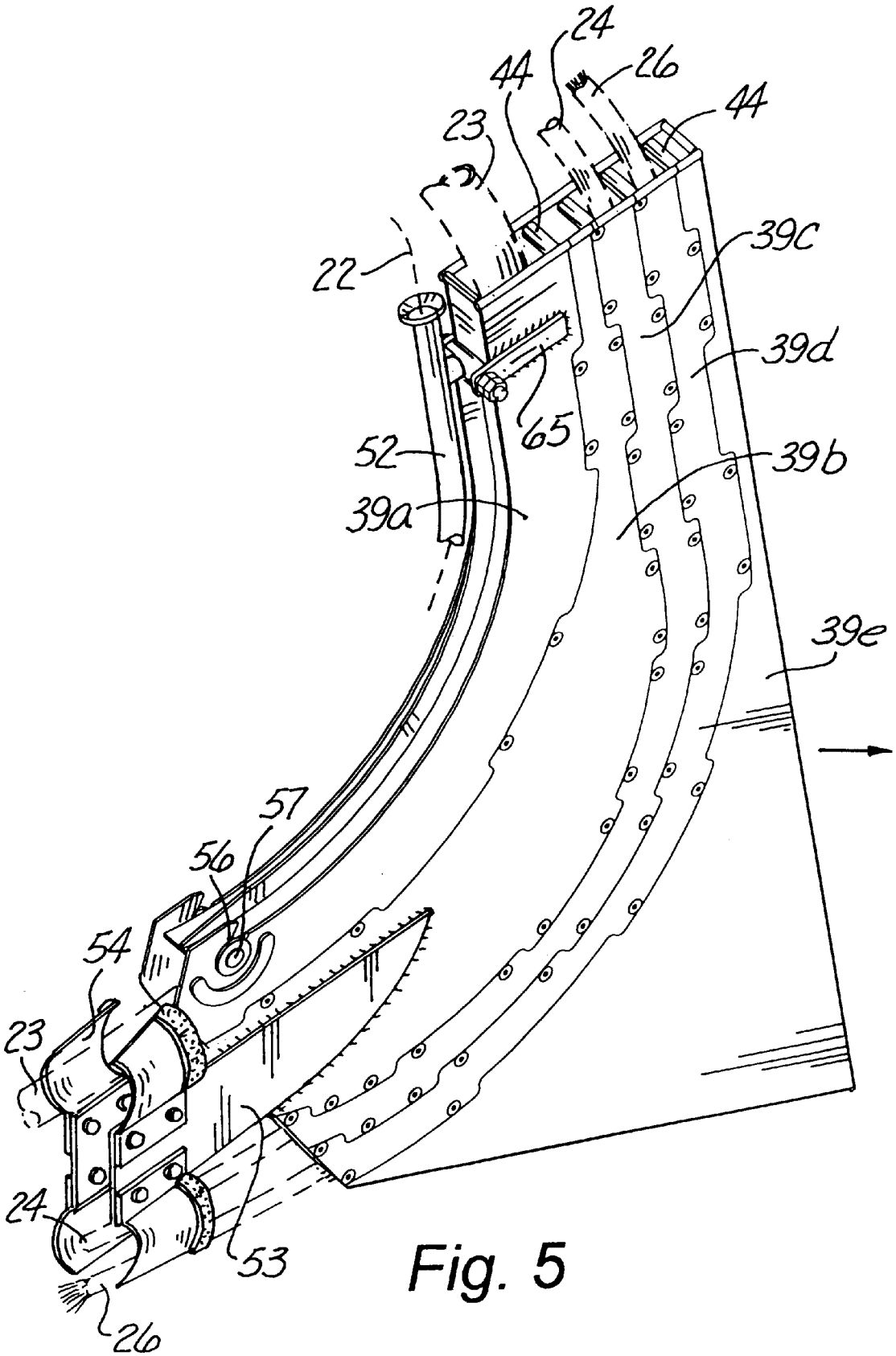
FIG. 5 is a perspective view of the guide chute of the present invention and showing cutters thereon for maintaining a predetermined distance between two of the utility lines.
Figure 6:
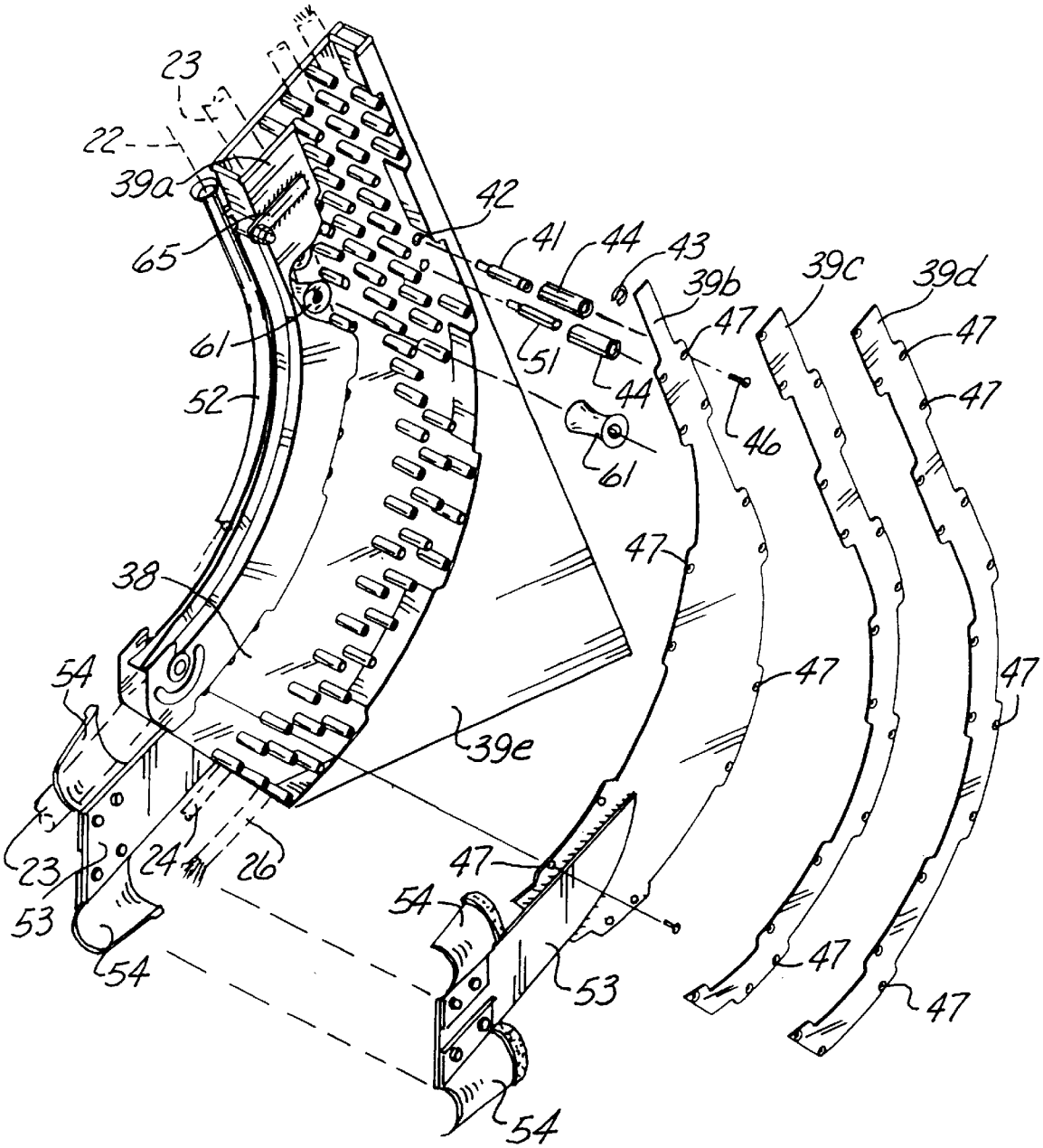
FIG. 6 is a view similar to FIG. 5 but showing some of the parts exploded away from one side of the guide chute and showing rollers for separating one utility line from another.

A guide chute 31 is shown in more detail in FIGS. 4, 5, 6 and 9. Referring to FIG. 4 it is noted that the plow 13 is set up with an articulated joint 32 at the top and the bottom and is configured for an vibratory action, the details of which are not shown because they are well known and do not form a part of the present invention. The guide chute 31 has an open top portion 33, a bottom 34, a front 36 and a rear 37. A first side 38 is shown in FIG. 6 and a second side 39 is comprised of portions 39*a*, 39*b*, 39*c*, 39*d*, all of which can be separated from each other part 39*e* is part of the assembly portion.

Figure 9:
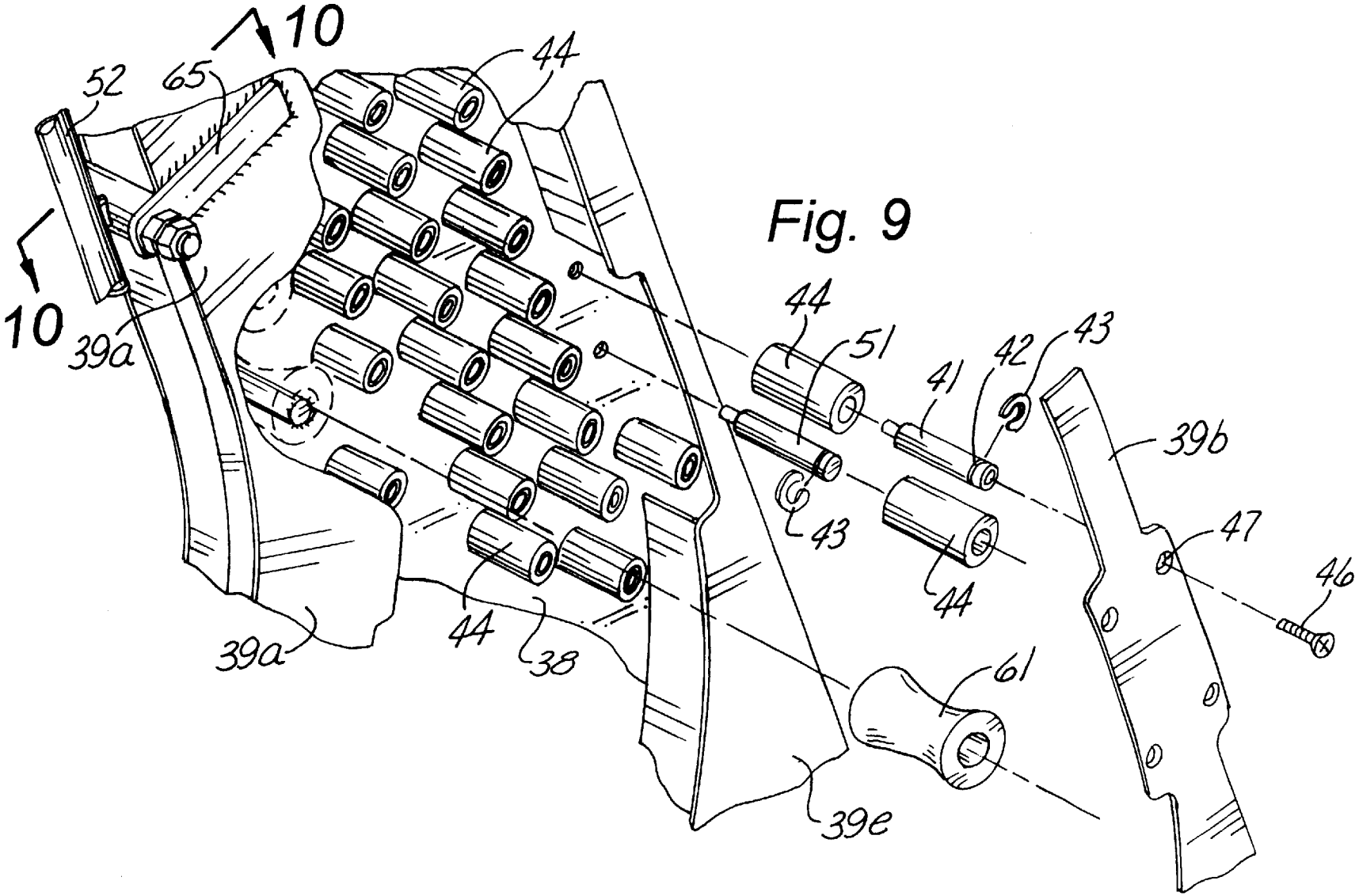
FIG. 9 is an enlarged, partial, exploded view of the guide chute from FIG. 6 and showing how the rollers and pins separate each utility line and also showing how some of the lines can be extracted by removing part of the side plate instead of the entire side plate.
Figure 10:
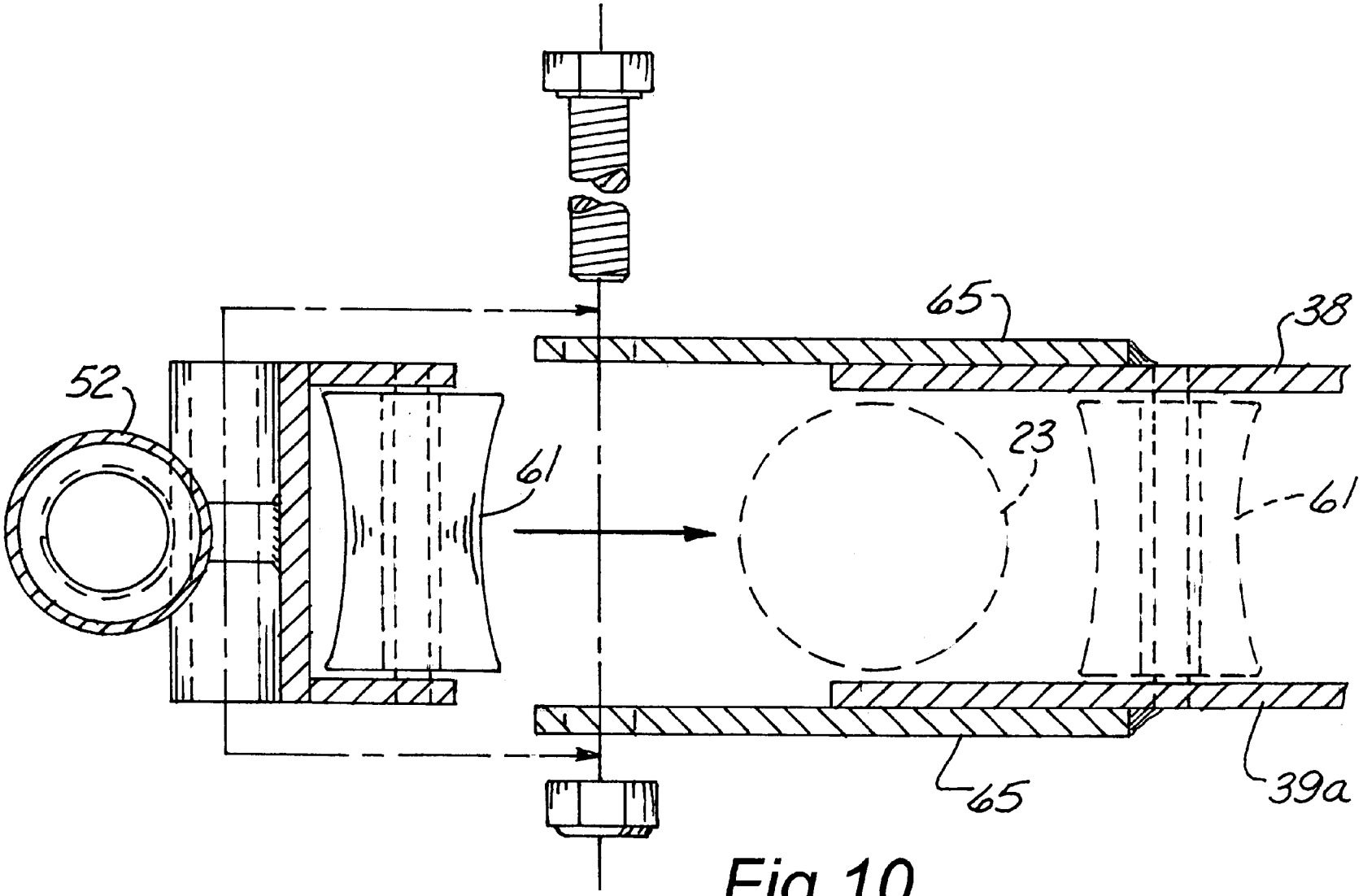
FIG. 10 is a cross-sectional view taken along line 10—10 of FIG. 9.

Referring to FIGS. 6 and 9, it is noted that the first side 38 has a plurality of pins 41 which extend into openings 42 in the first side 38 and then are welded in place. These pins 41 have a groove 42 therein for receiving a clip 43. A roller 44 slides over each one of the pins 41 and a threaded fastener 46 extending through holes 47 in the side plate 39*b* and into the end of a threaded pin 41 serve as a guide for each utility line and also serve to attach first side 38 to the second side 39. Dividers other than rollers can be used. Pins 51 are just like pins 41 except they do not have female threaded ends, but do have rollers 44 received on the pins 51. Also rollers 61 are provided for guiding gas line 23 through elbow 29 and guide chute 31 as shown in FIGS. 6, 9 and 10. Of course there are fasteners 46 (FIG. 9) which extend through each one of the openings 47 in the plate portions 39*b*, 39*c* and 39*d*.

FIG. 3 shows how the wire 22 is guided through loops 52*a* to guide tube 52 and gas line 23 is guided over roller 61 on the guide elbow 29 and ultimately is guided down into the guide chute 31. The locator wire 22 extends down through the guide conduit 52 operably attached to the front of the guide chute 31 as can be seen in FIGS. 3 and 4. FIG. 3 shows an additional utility line 25, which is not shown on the other views and is optional.

For illustrative purposes the line 23 is a gas line adjacent to the locator wire 22 and the line 26 is an electric line whereas the line 24 can be a telephone or television cable line or the combination thereof.

Figure 7:
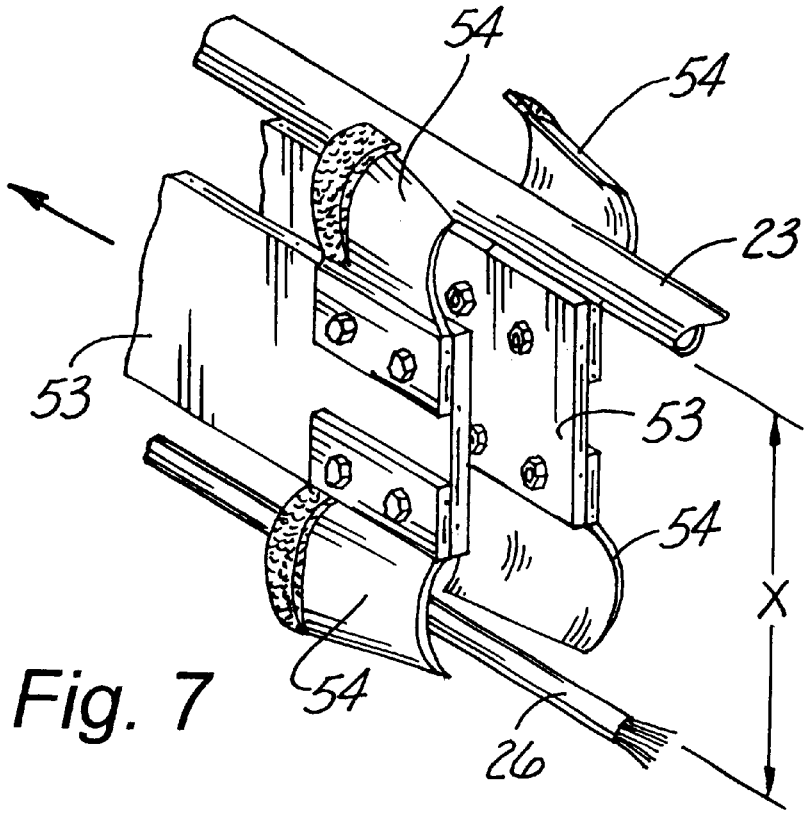
FIG. 7 is an enlarged partial perspective view of the cup cutter portion of the present invention which automatically cuts soil from the sides of a slot in the ground formed by the plow and compacts the soil between at least two utility lines to maintain a predetermined separation between such utility lines after they are installed in the ground.

Plate 39*b* as shown in FIG. 6 has a plate 53 welded thereto and top and bottom cutters 54 are bolted thereto. Similarly, referring to FIG. 6, for example, a plate 53 is also welded to the other side plate 38 with cup cutters 54 attached to plate 53 so that, as shown in FIGS. 5 and 7, there will be cup cutter 54 on each side of the gas line 23 and the electric line 26 if those are the two lines chosen as the most important to be maintained with a required separation therebetween.

Figure 2:
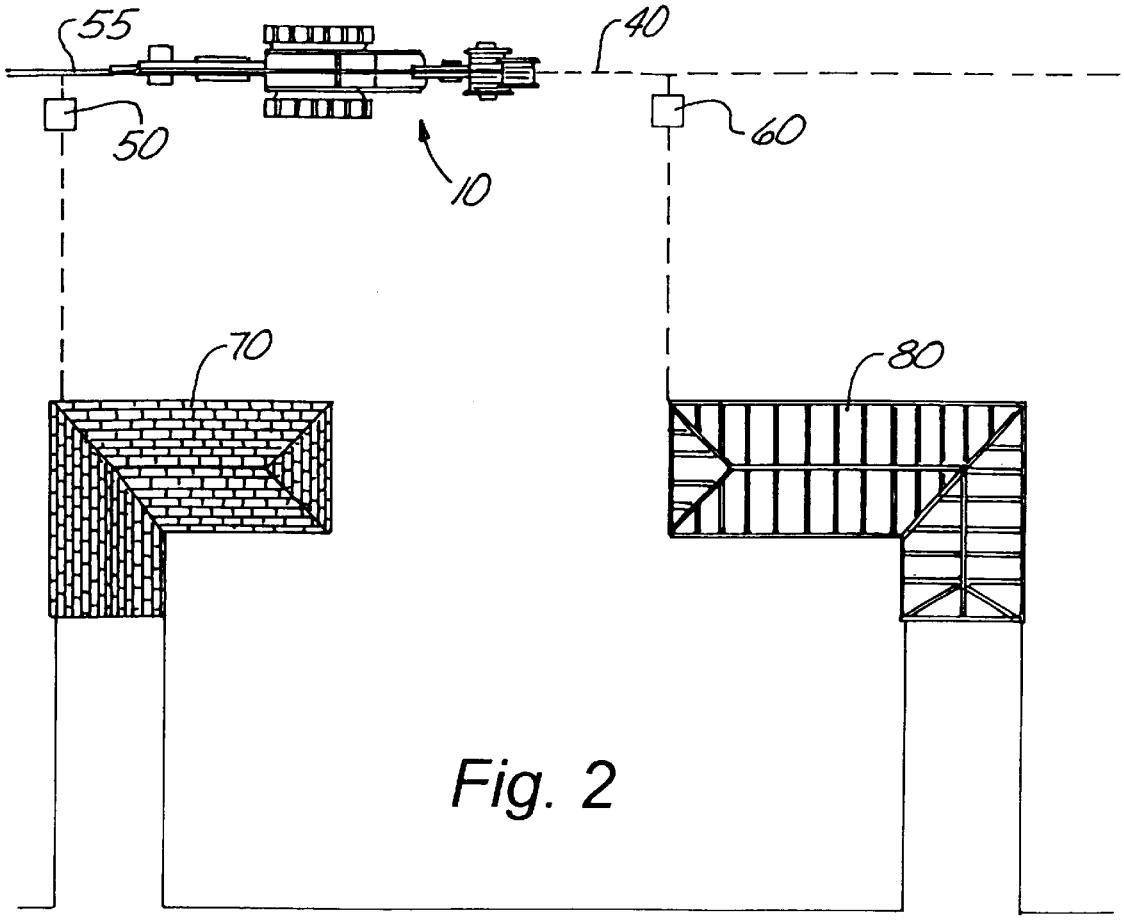
FIG. 2 is a top view of the preferred embodiment shown in FIG. 1 and also showing the top of two houses in a subdivision being built and showing how the present invention installs the utility lines adjacent to utility boxes to be attached to these new structures.

In operation, the apparatus 10 is shown in FIG. 2 operating along an easement 40 shown in dashed lines. The easement passes beside junction boxes 50 and 60, which lead to homes 70 and 80 respectively, which are being built in a subdivision, for example. As the prime mover 11 moves forwardly in the direction to the right as shown in FIGS. 1 and 2, the plow 13 will make a slot 55 in the ground as shown in FIG. 2. Because the guide, shown in FIGS. 3, 4, 5 and 6, will be guiding utility lines 23, 24, 25 and locator wire 22 into the ground as the apparatus 10 moves forwardly along the easement 40, the plow 13 will make the slot 55 and the drag from the utility lines will pull greater lengths of such utility lines 23, 24, and 26 off of spools 18, 19, and 20. Similarly the locator line 22 will be unreeled from reel 21 at the same rate. At the same time that this is occurring, cutter cups 54 are grabbing soil from each side of the slot 55 and pulling it into the space in between the utility lines 23 and 26 because the rear end of the cutter cups are smaller than and closer to the utility lines. The cutter cups 54 because of their shape, will automatically compact the soil around the lines 23 and 24. Consequently, if there is a predetermined requirement of separation between the lines 23 and 26, for example if 23 is a gas line and 26 is an electric line, then this predetermined separation can be maintained with confidence using the cup cutter 54 arrangement.

Figure 8:
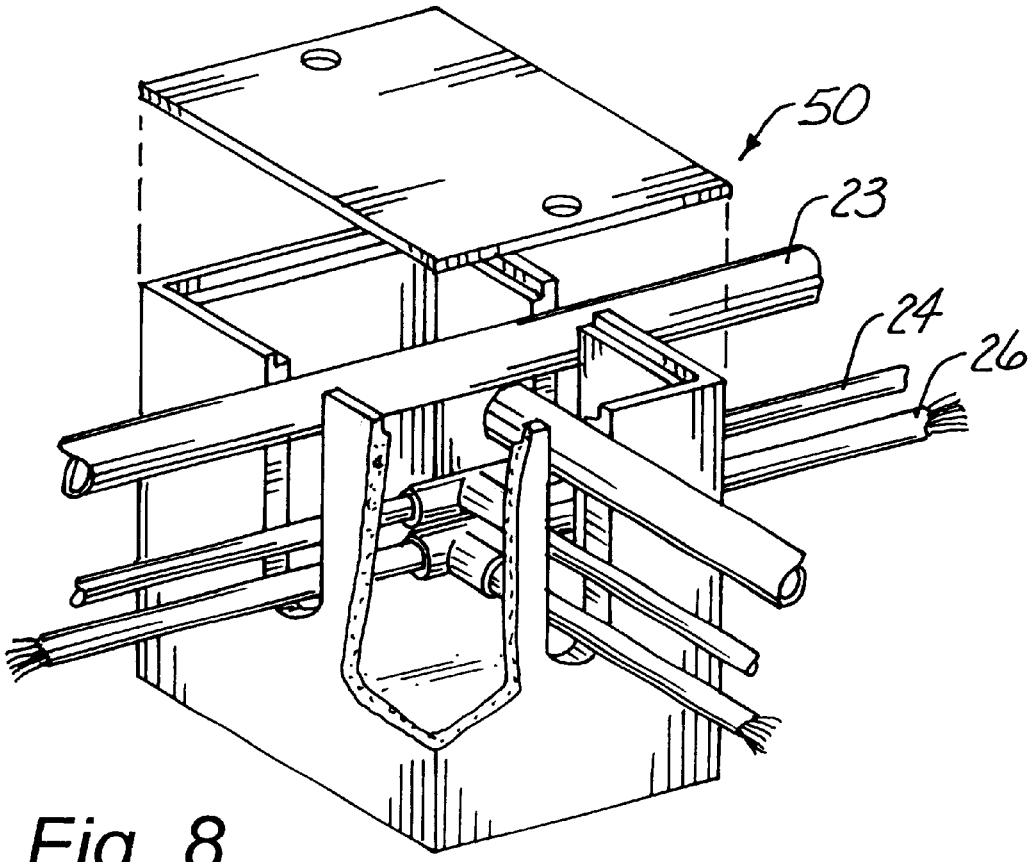
FIG. 8 is a perspective view of a utility box having utility lines passing into and out from the utility box.

At such time that the guide chute 31 reaches a utility box, such as the utility box 50 shown in FIGS. 2 and 8, the utility lines desired may be pulled from the chute by removing only as many of the plates 39*b*, 39*c* and 39*d* as are required. The plate 39*a* is not removable. It is secured to side plate 38 with pins 41 welded to side plate 38. Rollers 44 rotate on pins 41 to space plate 39*a* from side plate 38. One ear 65 is welded to side plate 38 and the other ear 65 is welded to plate 39*a*. Ears 65 have aligned holes that a tube welded to the chute gate slides between and is secured by a retaining bolt. The chute gate has a round bar 58 welded at the bottom and slides into slots on side plate 38 and plate 39*a*. The chute gate has a U-shaped channel with roller 61 secured in the channel with shafts 51 welded in place. To remove line 23, the chute gate retaining bolt is removed and pin 57 slides out of slots 56 in plates 38 and 39*a*. It will be noted in FIG. 5 that there is also utility line 24 between utility lines 23 and 26. To remove lines 23, 24 and 26 at a junction box 50, the portion 39*b* could remain in place while portions 39*a*, 39*c* and 39*d* could be removed to selectively remove utility lines 23, 24 and 26 regardless of whether there is or is not a utility line in the open space shown in FIG. 5 between lines 23 and 24. Of course if only the electric line 26 is to be removed then only plate 39*d* would be removed at the junction box 50.

Referring to FIG. 8, the junction box 50 shows a gas line 23 and electric line 26 and another utility line such as a fiber optic line, telephone line, or cable line 24. The gas line 23 is not shown attached in FIG. 8 because that is done by the natural gas company, whereas the other lines can be attached by other installers. Typically, the easement 40 is to one side of the junction boxes 50 and 60 and then, after the unit 10 passes by the junction box, workers dig a few feet between the slot 55 in the ground and the junction box 52 make the connections shown in FIG. 8.

Accordingly, it will be appreciated that the preferred embodiment shown herein does indeed accomplish the aforementioned objects. Obviously many modifications and variations of the present invention are possible in light of the above teachings. It is therefore to be understood that, within the scope of the appended claims, the invention may be practice otherwise than as specifically described.

We claim:

1. A plowing apparatus for installing multiple utility lined comprising:

a plow adapted to be attached to a prime mover for cutting an opening in the ground from the top of the ground to a predetermined distance below the surface of the ground as the prime mover moves along the surface of the ground, said plow having a front and a rear;

a utility line guide disposed rearwardly of said plow and operatively attached to said plow, said guide including a forward wall, a bottom wall, a first side wall on one side thereof and second side wall on the other side thereof operatively attached to said forward wall, and an at least partially open top being disposed between said first and second side walls for receiving utility lines to be installed into the ground;

divider members disposed between said first and second side walls for guiding multiple utility lines in the top of said guide and out a lower rearward portion of said guide whereby said utility lines can be laid into the ground at predetermined depths in vertically spaced relationships with respect to each other as said plow and guide move forward, a plurality of said divider members being permanently affixed to said first side wall; and wherein said first side wall being substantially unitary while said second side wall is composed of separate removable parts, the shape of respective ones of said separate parts corresponding at least in part to the position of each of more than one respective utility line within said guide whereby said separate removable parts of said second wall can be selectively removed from said first side wall while said first side wall remains attached to said forward wall to facilitate removal of selected ones of said utility lines out said other side without removing other ones of said utility lines when it is desired to remove one or more of said utility lines and replace said one or more of said utility lines when it is desired to continue a utility line laying type plowing operation.

2. The apparatus of claim 1 wherein at least some of said divider members are rollers.

3. The apparatus of claim 1 wherein the second parts of said second side wall have holes therein for receiving threaded fasteners.

4. The apparatus of claim 1 wherein the one of said utility lines is a gas line and another of said utility lines is an electric line.

5. The apparatus of claim 4 wherein another of said utility lines is a telephone line.

6. The apparatus of claim 4 wherein another of said utility lines is a cable television line.

7. The apparatus of claim 4 wherein another of said utility lines is a fiber optic line.

8. The apparatus of claim 4 wherein said gas line is non-metallic and a metal location wire is disposed above said gas line.

9. The apparatus of claim 4 wherein cup cutters are operatively attached to said guide and are disposed on each side of said gas line and electric line rearwardly of said guide whereby said ground will be compacted around said gas and electric lines and a predetermined distance will be maintained between said gas line and said electric line.

10. The apparatus of claim 9 wherein said cup cutters are wider at the front than at the rear thereof for causing a volume of dirt to be funneled out the rear thereof and at least partially filling a space between the gas line and electric line.

11. The apparatus of claim 1 wherein all of said divider members are permanently fixed to said first side wall and are removably affixed to said second side wall, whereby said separate parts of the second side wall can be removed from the first side wall without removing other parts of the second side wall from the first side wall.

12. The apparatus of claim 1 wherein said first side wall is integral with said forward wall.

13. The apparatus of claim 1 wherein said first side wall is a one piece member.

14. A plowing apparatus for installing multiple utility lines comprising:

a plow adapted to be attached to a prime mover for cutting an opening in the ground from the top of the ground to a predetermined distance below the surface of the ground as the prime mover moves along the surface of the ground, said plow having a front and a rear;

a utility line guide disposed rearwardly of said plow and operatively attached to said plow, said guide including a forward wall, a bottom wall, a first and second side wall operatively attached to said forward wall, and an at least partially open top being disposed between said first and second side walls for receiving utility lines, including at least a first line and an second line, to be installed into the ground;

divider members disposed between said first and second side walls for guiding multiple utility lines in the top of said guide and out a lower rearward portion of said guide whereby said utility lines can be laid into the ground at predetermined depths in vertically spaced relationships with respect to each other as said plow and guide move forward; and cup cutters operatively attached to said guide and disposed on each side of said first line and second line rearwardly of said guide whereby said ground will be compacted around said first and second lines and a predetermined distance will be maintained between said first line and said second line.

15. The apparatus of claim 14 wherein said first line is a gas line and said second line is an electric line.

16. The apparatus of claim 15 wherein cup cutters are operatively attached to said guide and are disposed on each side of said gas line and electric line rearwardly of said guide whereby said ground will be compacted around said gas and electric lines and a predetermined distance will be maintained between said gas line and said electric line.

17. The apparatus of claim 16 herein said cup cutters are wider at the front than at the rear thereof for causing a volume of dirt to be funneled out the rear thereof and at least partially filling a space between the gas line and electric line.

18. The apparatus of claims 1 or 16 which have spools of said utility lines rotatably disposed on said prime mover for feeding said utility lines from said spools to said guide.

* * * * *